US005230755A

United States Patent [19]

Pierantoni et al.

[11] Patent Number: 5,230,755

[45] Date of Patent: Jul. 27, 1993

[54] PROTECTIVE LAYER FOR A METAL SUBSTRATE AND A METHOD OF PRODUCING SAME

[75] Inventors: Michel Pierantoni, Lausanne; Roberto Busin, Gossau; James Simpson, Turbenthal; Roger Dekumbis, Zurich-Oerlikon, all of Switzerland

[73] Assignee: Sulzer Brothers Limited, Winterthur, Switzerland

[21] Appl. No.: 641,603

[22] Filed: Jan. 15, 1991

[30] Foreign Application Priority Data

Jan. 22, 1990 [CH] Switzerland ..... 181/90

[51] Int. Cl.[5] ..... C23C 4/00

[52] U.S. Cl. ..... 148/516; 148/524; 148/525; 148/527; 148/325; 148/326; 148/327; 427/380

[58] Field of Search ..... 148/13, 135, 325, 327, 148/133, 1, 4, 134, 326, 516, 524, 525, 527; 428/681; 427/380

[56] References Cited

U.S. PATENT DOCUMENTS

| | | | |
|---|---|---|---|
| 3,187,717 | 6/1965 | Pearsall | 118/64 |
| 3,834,950 | 9/1974 | Feltz | 148/327 |
| 4,015,100 | 3/1977 | Ginanamuthu et al. | 148/4 |
| 4,212,900 | 7/1980 | Serlin | 148/13 |
| 4,451,299 | 5/1984 | Smeggil et al. | 148/1 |

FOREIGN PATENT DOCUMENTS

| | | |
|---|---|---|
| 0290052 | 11/1988 | European Pat. Off. . |
| 3821896 | 12/1989 | Fed. Rep. of Germany . |
| 2166360 | 8/1973 | France . |
| 1-319658 | 12/1989 | Japan . |
| WO89/01534 | 2/1989 | World Int. Prop. O. . |
| WO89/10433 | 11/1989 | World Int. Prop. O. . |

OTHER PUBLICATIONS

Patent Abstracts of Japan, vol. 6, No. 78 (C-102) [956], May 15, 1982.

Patent Abstracts of Japan, vol. 11, No. 18 (C-398) [2465], Jan. 17, 1987.

Patent Abstracts of Japan, vol. 11, No. 43 (C-402) [2490], Feb. 7, 1987.

Patent Abstracts of Japan, vol. 11, No. 106 (C-414) [2553], Apr. 3, 1987.

Patent Abstracts of Japan, vol. 11, No. 259 (C-441) [2706], Aug. 21, 1987.

*Primary Examiner*—R. Dean
*Assistant Examiner*—Sikyin Ip
*Attorney, Agent, or Firm*—Kenyon & Kenyon

[57] ABSTRACT

A protective layer for a metal substrate is metallurgically bonded to the substrate and contains (as a percentage by mass) 35 to 50% chromium, up to 10% of which can be replaced by molybdenium, and at least iron, the proportion of iron being at least 25%. The minimum hardness is 800 HVO.1, obtained by a structure having a minimum content of 5% by volume as sigma phase. The sigma phase is obtained by heat-treatment of the coated substrate. The protective layer is particularly resistant to corrosion and also has good resistance to erosion and wear.

20 Claims, No Drawings

PROTECTIVE LAYER FOR A METAL SUBSTRATE AND A METHOD OF PRODUCING SAME

This invention relates to a protective layer for a metal substrate and to a method of producing the same. More particularly, this invention relates to a protective layer which is particularly efficient against corrosion, erosion and wear.

The protective layer is characterized by the following content (in % by mass), 35 to 50% chromium (Cr), 0 to 10% molybdenum (Mo) and remainder at least iron (Fe) with a minimum Fe content of 25% and by a minimum hardness of 800 HVO.1. The unit of hardness "HVO.1" is a DIN-standard (DIN50133) and means the (Vickers) pyramid hardness or diamond penetrator hardness with a test weight of 0.1 kp.

The protective action of the protective layer is obtained by forming a sigma phase, which must be in a proportion of at least 5% by volume to obtain the desired minimum hardness, and by a high content of chromium (or chromium and molybdenum). The sigma phase contains about 55% iron and 45% chromium and is characterized by great hardness and very low plastic deformability. Apart from the sigma phase, the hardness can also be increased, after suitable heat treatment, by other phases such as chi, alpha-prime and gamma-prime and precipitates such as carbides and nitrides.

A method of producing the protective layer is characterized in that the layer or metal material together with the surface of the substrate for coating are melted by a thermal melting process and cooled at a minimum rate of 100K/sec to at least 500° C., producing a metallurgically bonded protective layer having a hardness of less than 500 HVO.1, and the protective layer is then heat-treated in a temperature range of 500° to 950° C. until the hardness is at least 800 HVO.1.

Provided the aforementioned minimum proportion of iron is maintained, other elements can replace part of the iron to obtain certain effects. For example, carbon can be added to increase the conversion rate, i.e. the formation of the sigma phase. Other elements, such as silicon, niobium and titanium also help to form the sigma phase, particularly when the chromium content is relatively low.

If it is desired to increase the hardness of the protective layer, which can consist of one or more coatings, the proportion of the sigma phase in the structure is increased, advantageously to at least e.g. 50% by volume.

The protective layer, which advantageously can have a thickness between 0.01 and 3 millimeters (mm), is given good adhesion if the layer and the substrate are metallurgically bonded. The substrate can be any metal with a sufficiently high melting-point, iron-based alloys being preferred.

With regard to the manufacture of the protective layer, particularly good results are obtained if the layer material is blown in the form of a powder through a nozzle into the melting bath, the layer material being simultaneously melted and metallurgically bonded to the substrate. Of course, the layer material can also be supplied in the form of a rod or wire.

Optionally also, the substrate is precoated with the layer material and subsequently the two materials are metallurgically bonded to one another by melting. The precoating is advantageously applied galvanically or by thermal spraying, e.g. by CVD or PVD or vacuum plasma spraying. Finally, the surface to the substrate can simply be covered with the coating material in the form of a powder, wire, thin strips or plates, and the covering can be melted together with the substrate surface.

If the coating material is applied as a powder, wire or rod, melting can be brought about e.g. by a laser beam or an arc. Alternatively, in the case of precoated substrates, the energy source for melting can be an electron beam. Also, if required, the substrate can be preheated before precoating and/or before melting.

Finally, it is advantageous if the pretreatment for forming the sigma phase is carried out at about 700° C. for at least 6 hours.

These and other objects and advantages of the invention will become more apparent from the following detailed description of one embodiment of the invention.

The substrate to be coated was of carbon steel ST 37, to be covered with a layer 0.15 to 0.2 millimeters (mm) thick and containing iron and about 45% chromium.

The surface of the substrate for coating was first degreased and galvanically given a coating of pure chromium about 80 um thick. To prevent gas inclusions in the subsequent protective layer, the galvanically applied chromium-plate substrate was then heat-treated in air at about 200° C. for 4 to 6 hours.

The protective layer was made by melting the chromium-plated surface, using a laser beam. A laser beam having a power of 1500 W and a diameter of 1.23 millimeter (mm) at the surface for melting, corresponding to a power density of 1260 W/mm$^2$, was moved in a helium protective gas atmosphere in three runs over the chromium-plated substrate surface to be melted, in lines at a spacing of 0.2 millimeters (mm), the speed of advance being 1900, 1500 and 1000 mm/min. The resulting calculated periods of action were 31, 39 and 58 milliseconds (ms), which in this case corresponded to a cooling rate of least 2000K/sec allowing for the total mass of substrate and its thermal conductivity.

The purpose of repeated melting was to homogenize the protective layer, which was metallurgically bonded by melting with the substrate and which, after melting, had the required composition of about 45% chromium and 55% iron and small amounts of carbon, silicon, manganese and other trace elements from steel St 37. The layer after laser treatment was an intermediate product having a hardness of HVO.1 240–260, and its structure did not contain a sigma phase.

The structure was partly converted to a sigma phase by subsequent heat treatment at about 700° C.±25° C. in an oven in air for about 12 hours. Neither the heating rate nor the cooling rate are critical; it is only necessary to ensure the required holding time at the treatment temperature.

Metallurgical tests showed that the treated protective layer had a content of more than 80% by volume of the sigma phase The hardness of the layer was HVO.1 1200–1400.

The protective layer was particularly resistant to corrosion, which was confirmed by corrosion tests in 5% NaCl, the resistance to local corrosion (pitting or crevice corrosion) after heat treatment being better than in the case of austenitic stainless steel to DIN 1.4435 (X2 CrNiMo 18 12. AISI 316L). The measured critical pitting temperature was 16° C. for an Fe 44% Cr heat-treated laser-melted protective layer on St 37, as compared with 11.5° C. for 1.4435 stainless steel.

The protective layer which is formed in accordance with the invention may further be provided with one of the following elements in percent by mass:

| | | | |
|---|---|---|---|
| Nickel | 0–20 | Niobium | 0–0.5 |
| Manganese | 0–18 | Titanium | 0–0.5 |
| Copper | 0–5 | Nitrogen | 0–0.5 |
| Tungsten | 0–3 | Carbon | 0–0.4 |
| Vanadium | 0–2 | Aluminum | 0–0.4 |
| Silicon | 0–1.5 | Other (each) | <0.2 |

Further, the protective layer may have a thickness of from 0.1 to 3 millimeters. As noted above, at least 5% by volume of the protective layer should be present in the form of a sigma phase and, in some case with a proportion of the sigma phase being at least 50% by volume.

The protective layer for the metal substrate is characterized in being metallurgically bonded to the substrate and as containing, as a percentage by mass, from 35% to 50% chromium, up to 10% of which can be replaced by molybdenum, and at least iron, the proportion of iron being at least 25%.

What is claimed is:

1. A protected substrate comprising a substrate and a protective layer, said protective layer consisting essentially of, in % by mass, from about 35 to 50% chromium, from about 0 to 10% Molybdenum and balance iron, wherein the protective layer includes at least 25% iron, said protective layer having a minimum hardness of 800 HVO.1 and wherein at least a portion of said protective layer is present in the form of a sigma phase.

2. A protected substrate as set forth in claim 1, wherein the protective layer further includes at least one of the following elements:

| | | | |
|---|---|---|---|
| Nickel | 20 or less | Niobium | 0.5 or less |
| Manganese | 18 or less | Titanium | 0.5 or less |
| Copper | 5 or less | Nitrogen | 0.5 or less |
| Tungsten | 3 or less | Carbon | 0.4 or less |
| Vanadium | 2 or less | Aluminum | 0.4 or less |
| Silicon | 1.5 or less. | | |

3. A protected substrate as set forth in claim 2, wherein said protective layer has a thickness of from 0.1 to 3 millimeters.

4. A protected substrate as set forth in claim 3, wherein at least 5% by volume of the layer is present in the form of a sigma phase.

5. A protected substrate as set forth in claim 4, wherein the proportion of sigma phase is at least 50% by volume.

6. A protected substrate as set forth in claim 1, wherein said protective layer has a thickness of from 0.1 to 3 millimeters.

7. A protected substrate as set forth in claim 1, wherein at least 5% by volume of the layer is present in the form of a sigma phase.

8. A protected substrate as set forth in claim 7, wherein the proportion of sigma phase is at least 50% by volume.

9. A protected substrate comprising, a metal substrate; and a protective layer metallurgically bonded to said substrate, said layer consisting essentially of, in % by mass, from about 35 to 50% chromium, up to 10% Molybdenum and balance iron, wherein said protective layer includes at least 25% iron, said protective layer having a minimum hardness of 800 HVO.1 and wherein at least a portion of said protective layer is present in the form of a sigma phase.

10. A method of producing a protective layer on a metal substrate comprising the steps of melting a surface of a metal substrate together with a metal material to form a molten bath on the substrate;

thereafter cooling the melted metals in said bath at a minimum rate of 100K/sec to a temperature less than about 500° C. to produce a metallurgically bonded protective layer, wherein the protective layer consists essentially of, in % by mass, from about 35 to 50% chromium, from about 0 to 10% Molybdenum and balance iron, wherein said protective layer includes at least 25% iron, said protective layer having a hardness less than 500HVO.1 on the substrate; and thereafter heat-treating the protective layer in a temperature range of from 500° C. to 950° C. until the protective layer is at a hardness of at least 800 HVO.1 and wherein at least a portion of the protective layer is present in the form of a sigma phase.

11. A method as set forth in claim 10 wherein the metal material is blow in powder form into said molten bath for simultaneous melting and metallurgical bonding to the substrate.

12. A method as set forth in claim 10 wherein the metal material is precoated on the surface of the substrate prior to melting therewith.

13. A method as set forth in claim 12 which further comprises the step of preheating the surface of the substrate prior to precoating with the metal material.

14. A method as set forth in claim 12 wherein the metal material is precoated by one of a galvanical step and a thermal spray step.

15. A method as set forth in claim 10 wherein the surface of the metal substrate is melted by a device selected from the group consisting of a laser beam, an electron beam and an arc.

16. A method as set forth in claim 10 wherein said heat-treating step is performed at a temperature in a range of from 675° C. to 725° C. for at least 6 hours.

17. A method of producing a protective coating on a substrate comprising the steps of coating a layer of pure chromium on a metal substrate;

melting the coated layer together with the substrate to form a molten bath;

thereafter cooling the molten bath to form a protective layer on the substrate with the chromium in the layer metallurgically bonded to the metal substrate; and thereafter heat-treating the protective layer in a temperature range of from 500° C. to 950° C. until the protective layer is at a hardness of 800HVO.1 and at least a portion of the protective layer is present in the form of a sigma phase.

18. A method as set forth in claim 17 which further comprises the step of heat-treating the coated substrate of about 200° C. for 4 to 6 hours prior to melting thereof.

19. A method as set forth in claim 17 wherein said step of heat-treating is sufficient to obtain a hardness of from 1100 to 1400 HVO.1 in said protective layer.

20. A method as set forth in claim 19 wherein said heat-treating step is performed over a time period of about 12 hours.

* * * * *

UNITED STATES PATENT AND TRADEMARK OFFICE

CERTIFICATE OF CORRECTION

PATENT NO. : 5,230,755

DATED : July 27, 1993

INVENTOR(S) : Pierantoni et al.

It is certified that error appears in the above-identified patent and that said Letters Patent is hereby corrected as shown below:

Column 3, line 34, change "elements:" to --elements (in % by mass):--; and

Column 4, line 64, change "1100" to --1200--.

Signed and Sealed this

Sixteenth Day of August, 1994

*Attest:*

*Attesting Officer*

BRUCE LEHMAN

*Commissioner of Patents and Trademarks*